US006481691B1

(12) United States Patent
Irving

(10) Patent No.: US 6,481,691 B1
(45) Date of Patent: Nov. 19, 2002

(54) FASTENER PULLER

(75) Inventor: John R. Irving, Weston (CA)

(73) Assignee: Stay Pull Inc., Weston (CA)

( * ) Notice: Subject to any disclaimer, the term of this patent is extended or adjusted under 35 U.S.C. 154(b) by 52 days.

(21) Appl. No.: 09/671,165

(22) Filed: Sep. 28, 2000

(51) Int. Cl.[7] ..... B25C 11/00

(52) U.S. Cl. ..... 254/28; 254/18; 29/252; 227/63

(58) Field of Search ..... 254/28, 18, 121, 254/128, 134, 20; 227/63, 134; 29/252

(56) References Cited

U.S. PATENT DOCUMENTS

| | | | | | |
|---|---|---|---|---|---|
| 2,277,587 | A | * | 3/1942 | Gustafson | 254/28 |
| 2,592,570 | A | * | 4/1952 | Hofstetter | 254/28 |
| 2,638,313 | A | | 5/1953 | Marano | |
| 2,762,604 | A | * | 9/1956 | Misson | 254/28 |
| 3,563,513 | A | * | 2/1971 | Rubin | 254/28 |
| 3,978,576 | A | * | 9/1976 | Mustoe | 254/18 |
| 4,245,817 | A | | 1/1981 | Peoples | |
| 4,293,119 | A | * | 10/1981 | Diedrichs | 254/28 |
| 4,637,538 | A | * | 1/1987 | Wagner | 227/63 |
| 5,707,377 | A | | 1/1998 | Keller et al. | |
| 6,364,288 | B1 | * | 4/2002 | Laughlin | 254/18 |

FOREIGN PATENT DOCUMENTS

| | | | | |
|---|---|---|---|---|
| JP | 0030474 | * | 1/1990 | 254/28 |
| JP | 404002476 | * | 1/1992 | 254/28 |

* cited by examiner

*Primary Examiner*—Joseph J. Hai, III
*Assistant Examiner*—Daniel Shanley
(74) *Attorney, Agent, or Firm*—Bereskin & Parr

(57) ABSTRACT

A fastener puller capable of removing fasteners embedded in a material having a surface, the puller having a handle, a horn having a wedge, connecting means form mounting the horn to the handle and an elongated ram slidably mounted with respect to the handle. As the ram is moved along a slide path, the ram abuts the horn causing the wedge to be forced underneath the head of a fastener. As the ram continues along the slide path and contacts the surface, the horn and handle are pushed away from the surface causing the fastener to be pulled out of the material.

17 Claims, 12 Drawing Sheets

FASTENER PULLER

FIELD OF THE INVENTION

This invention relates to an apparatus for pulling fasteners and more particularly to hand tools for pulling upholstery staples and nails.

BACKGROUND OF THE INVENTION

Fasteners, such as staples and nails, that have been embedded in wood are used in a wide variety of applications. Fore example, fabric is often affixed to the wooden frames of upholstered furniture using upholstery staples. Upholstery staples have elongated points so as to be embedded deep into a wood frame. Upholstery staples are embedded deep into a wooden frame so as to maintain the fabric in place for a long time.

When reupholstering furniture however, it is often very difficult to remove the staples so as to place new fabric on the frame because the staples are embedded very deep into the wood. Generally, the staples are removed by pliers, flat screwdrivers and awls. These tools can make the staple removal process very time-consuming. In fact, it can take nearly one hour for one person to remove the staples from a standard wing chair. In many situations, the staples are left in the frame and a new staple is embedded in the frame at a different location for the new fabric. This latter option is considered to be poor upholstery practice.

Two hand tools have been developed to assist in this process. In U.S. Pat. No. 4,245,817 to Peoples a pneumatic staple puller was proposed. This used two claw members to pierce underneath the crown of the staple and to lift the staple from the wood. U.S. Pat. No. 4,637,538 to Wagner proposed a hand-held tool which is used to drive a wedge underneath the crown of the staple from the side. The Peoples staple puller requires great precision and the ends of the claw members are likely to break after repeated removals. The Wagner staple puller suffers from a disadvantage that it is applied at an angle to the surface in which the staple is embedded. As a result, there will be situations where there will not be room for the main housing of the staple puller because the frame of the furniture will be in the way. As well, the chisel-shaped end portion of the puller must be manually lodged underneath the crown of the staple before the device is activated. This may not be possible when the staple is deeply embedded in the material.

As well, it is also difficult to remove nails embedded in wood. Generally, the claw of a hammer is used to pull a nail from wood. However, if the head of the nail is below the surface of the wood, it is difficult to position the claw underneath the head of the nail.

Accordingly, there is a need for a pneumatically powered fastener puller which is fast, easy to use and may be applied perpendicular to the surface in which the fastener is embedded.

SUMMARY OF THE INVENTION

The present invention is accordingly directed to a fastener puller for removing a fastener such as a staple or a nail embedded in a material having a surface.

The subject fastener puller has a handle and connecting means fixedly attached to the handle for connecting a horn to the handle. The horn is mounted on the connecting means and has an elongated stem with an end and a wedge at the end of the stem. The wedge is adapted to fit underneath the head of a fastener. The horn is mounted so that it is moveable relative to the handle from a disengaged horn position to an engaged horn position. An elongated ram is slidably mounted with respect to the handle for longitudinally slidable movement along a slide path from a first ram position through a second ram position to a third ram position. The horn is positioned relative to the ram so that when the ram moves from the first position to the second position, the ram abuts the horn and causes the horn to move from the disengaged position to the engaged position. The ram is positioned so that when the ram moves from the second position to the third position, the ram is in continuous contact with the surface.

The fastener puller may also comprise pneumatic or electrical means for moving the ram along the slide path.

The fastener puller may also have a guide rod fixedly mounted with respect to the handle. The guide rod has a slot adapted to fit about the head of an embedded fastener.

The horn of the fastener puller may be biased to the disengaged position by a biasing member to the disengaged position.

In another aspect of the invention, the staple puller may have an adjusting member for adjusting the position of the horn with respect to the guide rod.

In an alternative embodiment to the invention, the staple puller may have a ram handle with an elongated ram fixedly mounted on the ram handle. A pull member is slidably mounted with respect to the ram handle and a horn is pivotally mounted to the pull member. The horn has an elongated stem and a wedge at the end of the stem. The wedge of the horn is adapted to fit underneath the crown of the staple. The horn is pivotable from a first horn angle relative to the ram to a second horn angle. The horn is positioned so that when the ram is pushed towards the surface, the ram abuts the horn and moves the horn from the first horn angle to the second horn angle.

BRIEF DESCRIPTION OF THE DRAWINGS

The invention will now be described, by way of example only, with reference to the following drawings in which.

DETAILED DESCRIPTION OF THE PREFERRED EMBODIMENT

Figure 1:
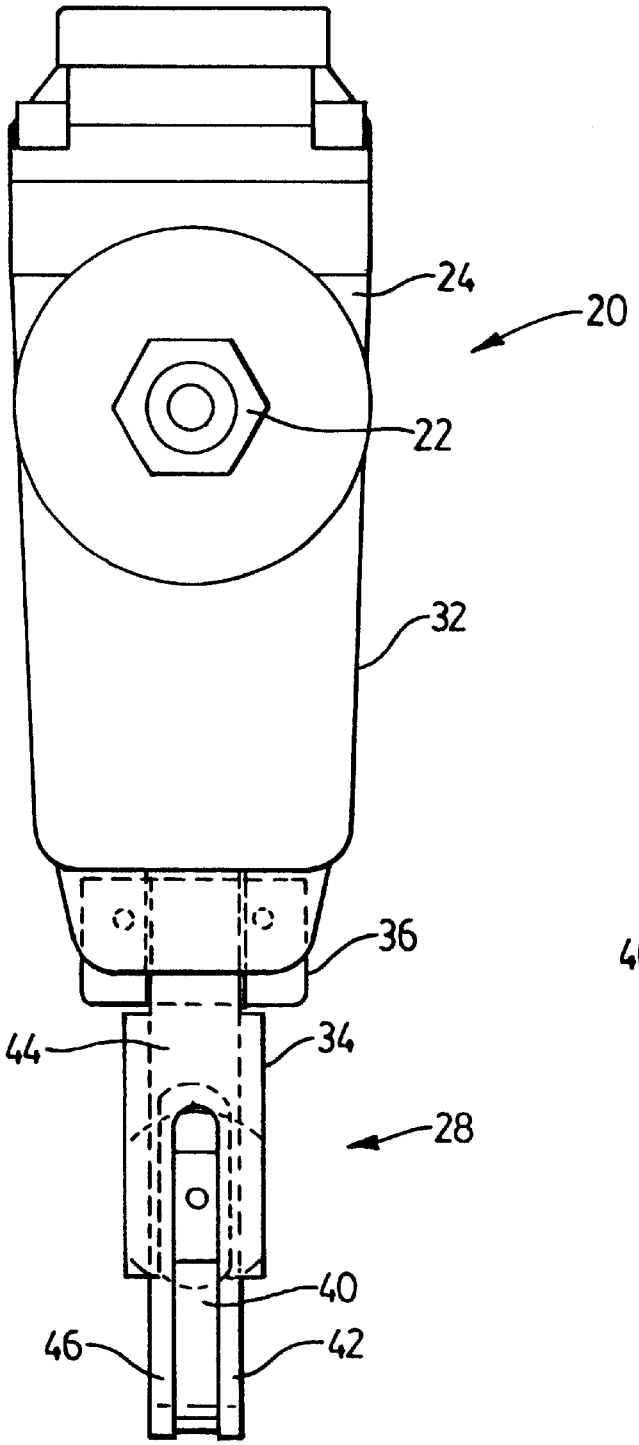
FIG. 1 is a front view of a staple puller in accordance with a preferred embodiment of the present invention with the trigger removed.
Figure 2:
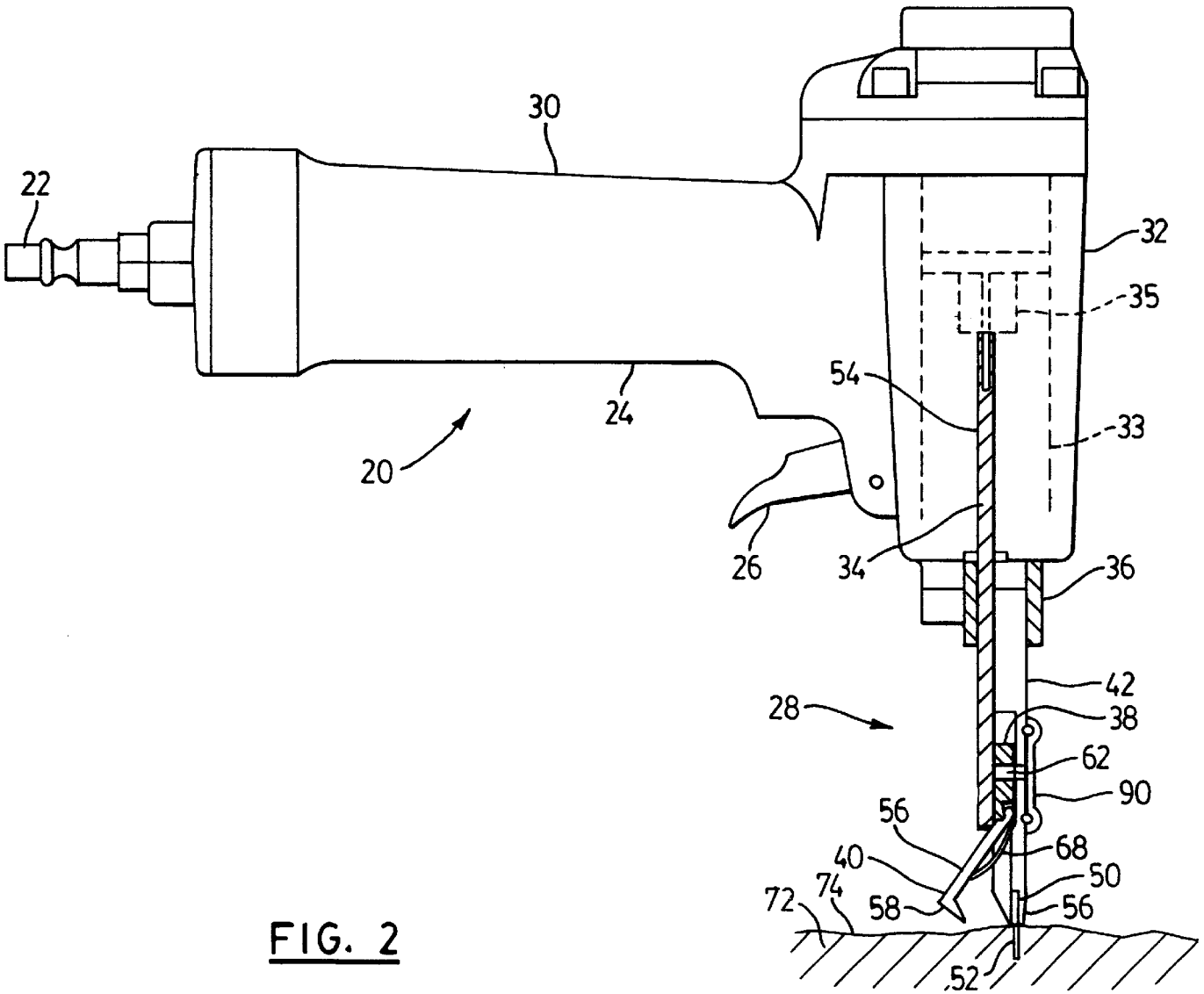
FIG. 2 is a partial sectional side view of the staple puller of FIG. 1.

Referring to FIGS. 1 and 2, illustrated therein is a pneumatic fastener puller 20 made in accordance with a preferred embodiment of the present invention. Except where otherwise stated, fastener puller 20 will be described as a staple puller. Pneumatic staple puller 20 includes an air inlet port 22, a housing 24, a trigger 26, and a tool extension 28. Staple puller 20 may be connected to a source of pressurized air via air inlet port 22.

In this application, the perpendicular direction is generally indicated by tool extension 28 with a material 72 defining the bottom of FIG. 2.

Housing 24 is composed of handle 30 and cylinder housing 32. An air flow path extends from air inlet port 22 through handle 30 to a cylinder 33 positioned within cylinder housing 32. Trigger 26, when depressed, allows pressurized air to flow from air inlet port 22 through housing 24 and into cylinder 33. A piston 35 is positioned within cylinder 33 and is forced towards the lower end of cylinder 33 as the pressurized air enters cylinder 33.

Tool extension 28 comprises a ram 34, U-bracket 36, pillow bushing 38, horn 40 and plunge rod 42.

Figure 1A:
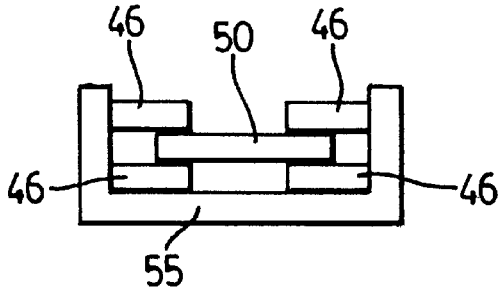
FIG. 1A is a bottom view of the base of a component part of the staple puller of FIG. 1.

Plunge rod 42 is affixed to the bottom of cylinder housing 32 by means of U-bracket 36. Plunge rod 42 is composed of an upper rod 44 and a guide rod 46. The upper end of upper rod 44 is affixed to U-bracket 36 by bolts (not shown). Plunge rod 42 extends downwardly from cylinder housing 32. The bottom end of guide rod 46 is shaped to fit around a head or crown 50 of a staple 52 while allowing the base of horn 40 to pass underneath crown 50. FIG. 1A shows a sample cross-section of the bottom end of guide rod 46 adjacent to the four comers of crown 50. It will be appreciated that other configurations for the bottom end of guide rod 46 can be used so long as lateral motion of the crown 50 of staple 52 relative to the guide rod may be prevented.

Ram 34 is composed of a ram stem 54 and a ram base 55. Ram stem 54 is an elongated member extending into cylinder housing 32 and is affixed to piston 35 therein. Ram base 55 is shaped to surround plunge rod 42 in a channel therein, as shown in FIG. 1A.

Horn 40 comprises a horn stem 56 and a horn wedge 58. Horn 40 is mounted on pillow bushing 38. Pillow bushing 38 is mounted between plunge rod 42 and ram 34 by means of a horn pin 62 passing through plunge rod 42 and pillow bushing 38. Pillow bushing 38 is provided with a groove 64 into which a horn mount 66 protrudes. Groove 64 lies adjacent to plunge rod 42 and is sized to fit the width of horn stem 56 when horn 40 is parallel to plunge rod 42. Guide rod 46 is provided with a horn channel 65 into which horn stem 56 will fit when in the vertical position.

The upper end of horn stem 58 is provided with an indentation 70. Horn mount 66 fits within indentation 70 such that horn 40 pivots about horn mount 66. A biasing member such as a leaf spring 68 is mounted between pillow bushing 38 and plunge rod 42 and is affixed at its end to approximately the midpoint of horn stem 56. Leaf spring 68 biases horn wedge 58 at a first angle away from guide rod 46 to a disengaged position.

Horn 40 is mounted such that horn wedge 58 is positioned to fit underneath the crown 50 of a staple 52 located within guide rod 46 when horn 40 is pivoted towards plunge rod 42.

Figure 3:
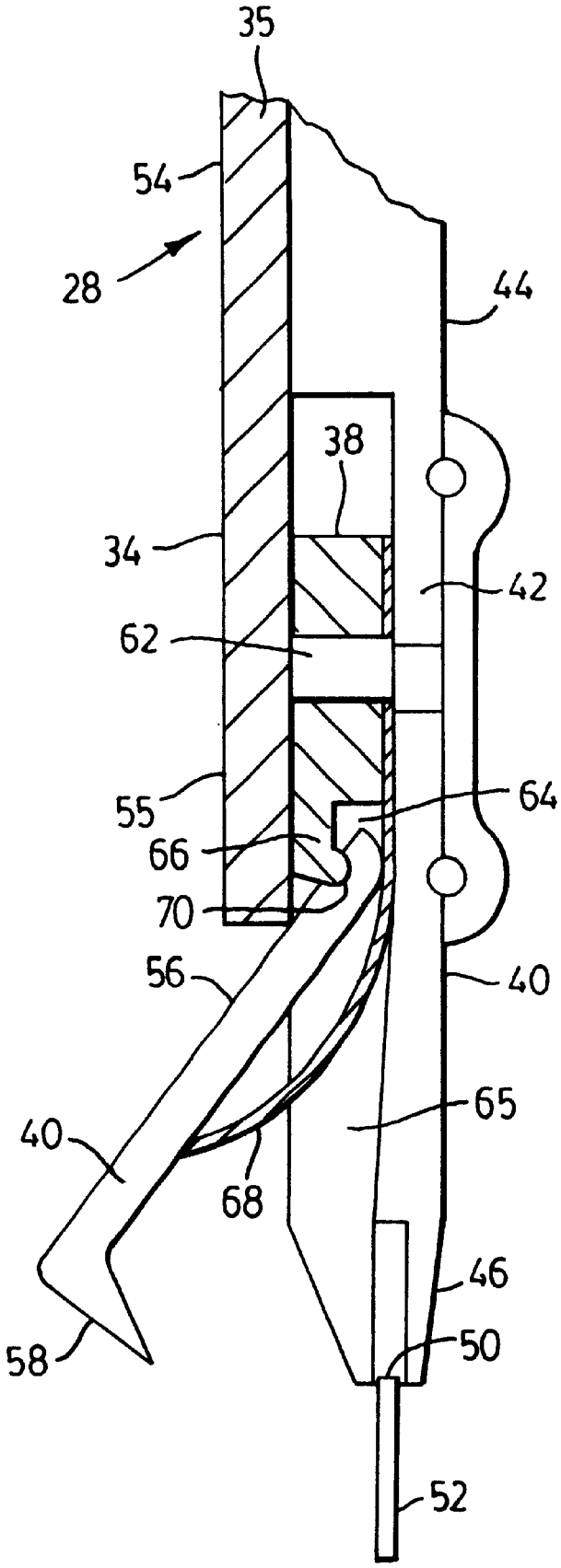
FIG. 3 is a side view of the component of FIG. 2 prior to operation.
Figure 4:
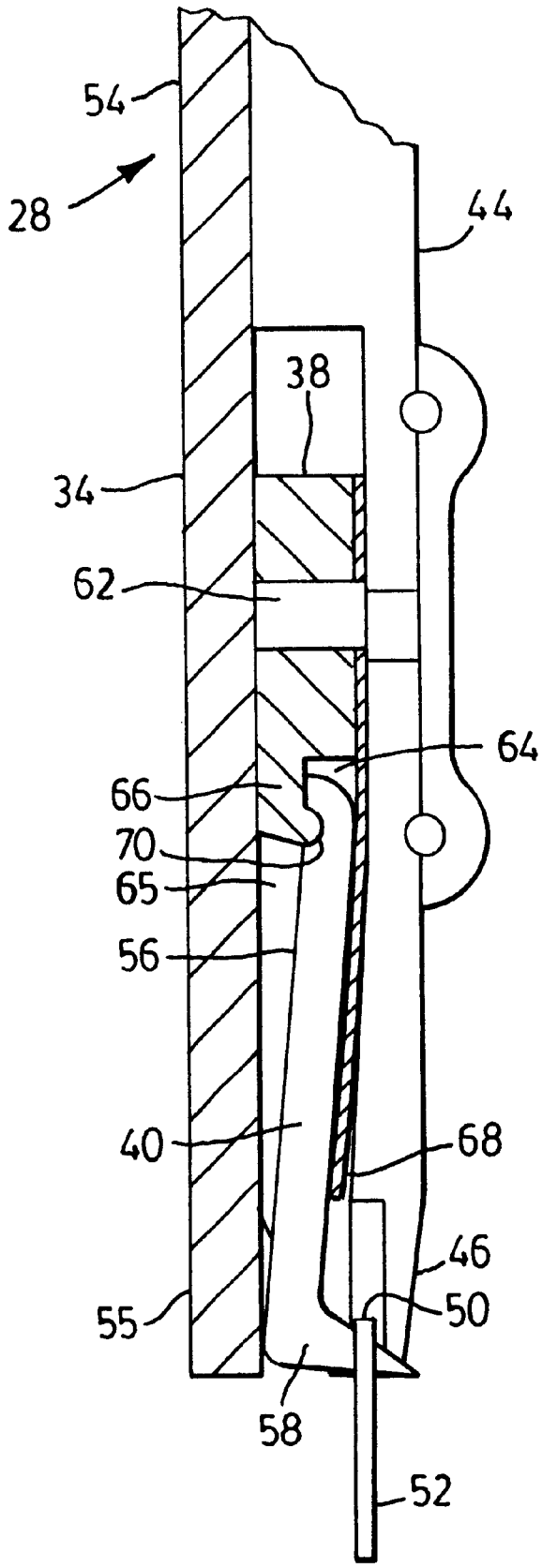
FIG. 4 is a side view of the component of FIG. 3 in a second position.
Figure 5:
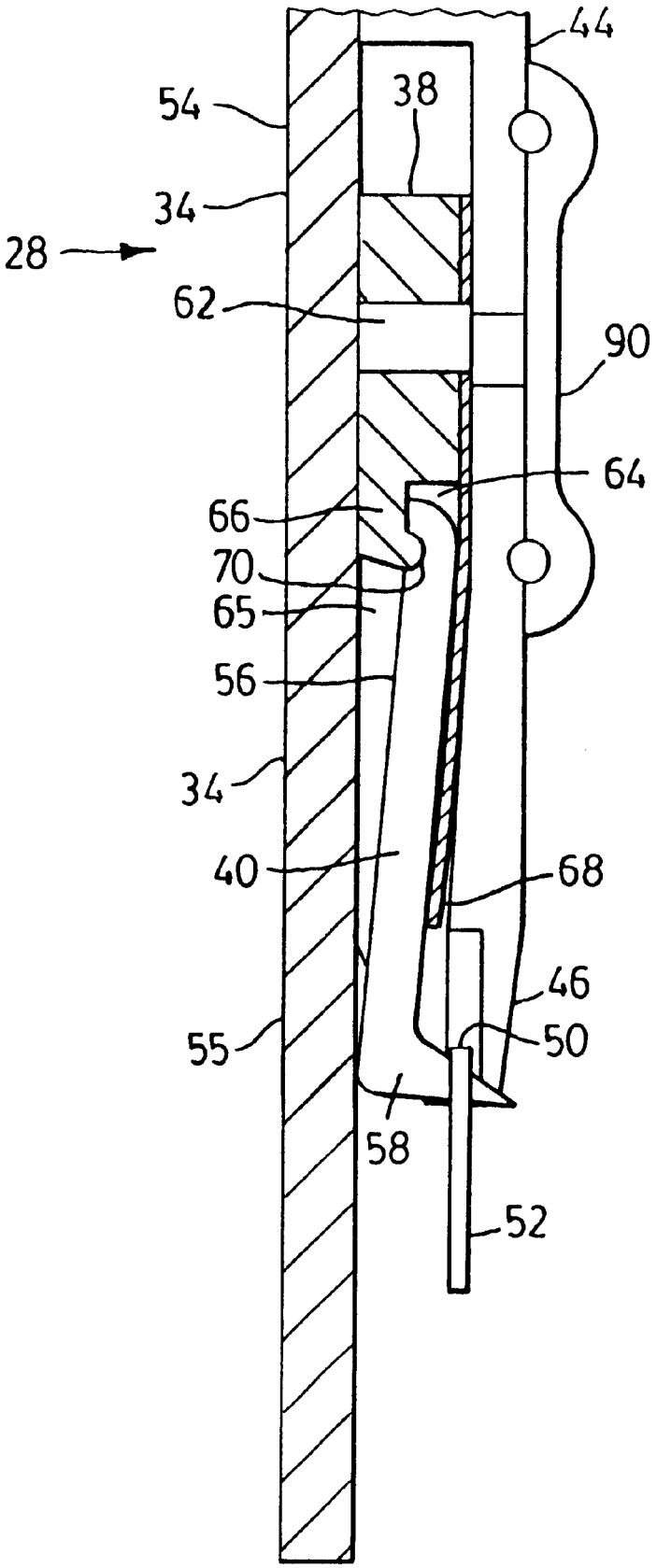
FIG. 5 is a side view of the component of FIG. 3 in a third position.

In operation, the lower end of guide rod 46 is placed over the crown 50 of staple 52 embedded in a material 72. Staple puller 20 is oriented as shown in FIG. 2 with handle 30 generally parallel to a surface 74 of material 72 and cylinder housing 32 generally perpendicular to surface 74. Air inlet port 22 is connected to a pressurized air source. As shown in FIGS. 2 and 3, ram 34 is placed in a first ram position within cylinder housing 32 such that horn wedge 58 is allowed to assume its disengaged position away from the central axis of plunge rod 42. When trigger 26 is depressed, highly pressurized air is permitted to enter air inlet port 22 and passes into cylinder 33. The pressure of the air feeding cylinder 33 forces piston 35 and ram 34 which is attached thereto downwards. Ram 34 in its downward motion from its first ram position to a second ram position as shown in FIG. 4, frictionally engages horn stem 56 forcing horn wedge 58 towards the staple 52 located at the bottom of guide rod 46. As ram 34 descends rapidly to the second ram position, horn 40 is pivotally forced from the disengaged position to the engaged position and horn wedge 58 is forced underneath crown 50 of staple 52 lifting it upwards along the wedge. Horn wedge 58 is received within the base of guide rod 46. Horn stem 56 is also received in horn channel 65. Crown 50 of staple 52 is held in place between guide rod 46 and horn wedge 58. At the second ram position, ram 34 is in contact with surface 74. As air continues to flow into cylinder 33, ram 34 is forced downwards to a third ram position as shown in FIG. 5. As ram 34 is forced against the surface 74 of material 72, housing 24 of pneumatic staple puller 20 is forced upwards away from material 72. As housing 24 is pushed upwards, horn 40 and plunge rod 42 are also pushed away from the surface. As horn wedge 58 is underneath crown 50 of staple 52, staple 52 is pulled out of material 72.

Figure 6:
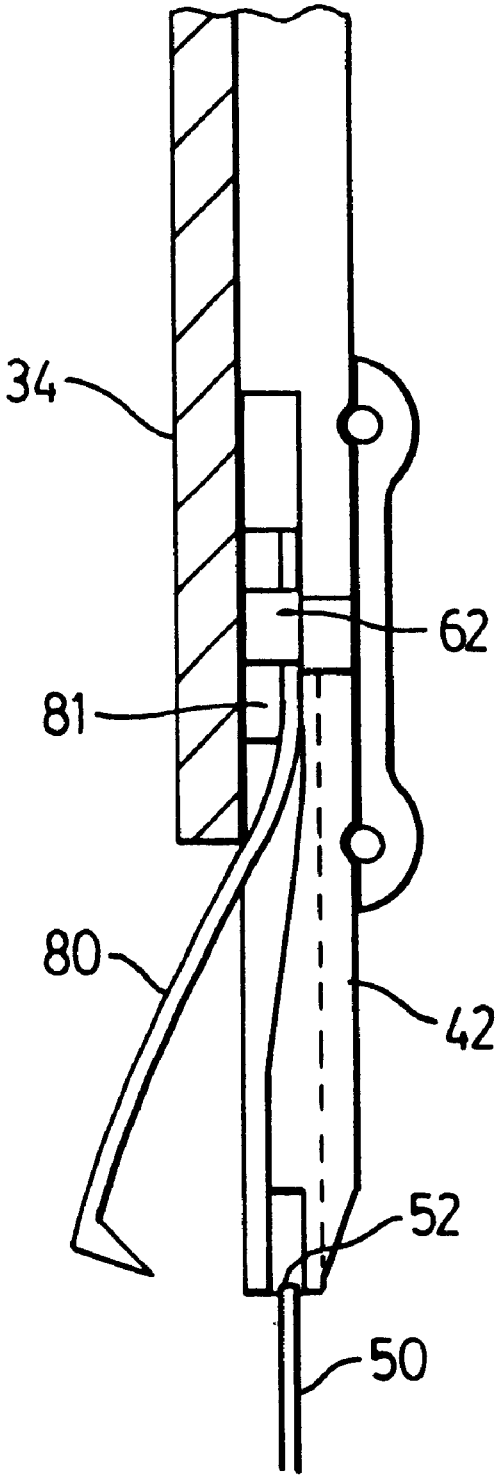
FIG. 6 is a side view of an alternative preferred embodiment of a tool extension in accordance with an aspect of the present invention.

It will be appreciated that numerous variants of the above invention may be made. FIG. 6 shows an alternative embodiment of the present invention with a different configuration of the horn. In this embodiment, horn 80 is a prestressed metallic member bent away from plunge rod 42. Essentially, horn 80 acts as a leaf spring. Horn pin 62 affixes pillow bushing 81 and horn 80 to plunge rod 42. As ram 34 moves towards surface 74, horn 80 is pushed inwards towards plunge rod 42 so that horn wedge 58 passes underneath crown 50 of staple 52.

Figure 7:
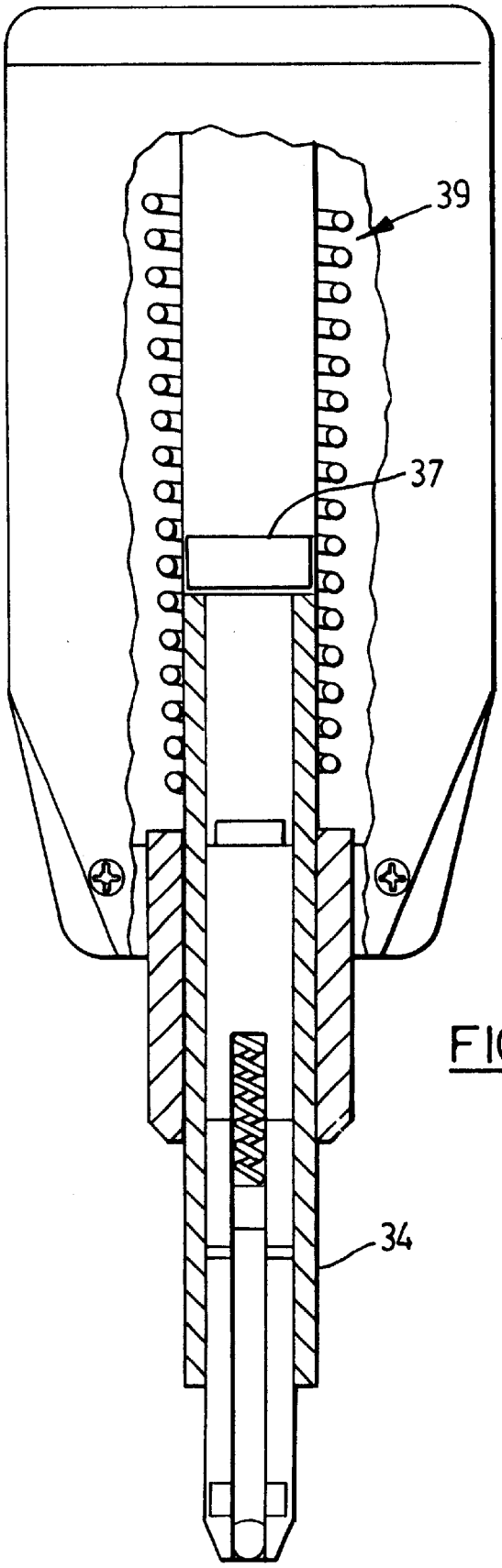
FIG. 7 is a front view of a further alternative embodiment of the present invention.

The invention is not limited solely to pneumatically-powered devices. In one variant of the present invention shown in FIG. 7, ram 34 is affixed to a core 37 within a cylindrical solenoid 39. A trigger (not shown) causes a current to pass through the solenoid 39, resulting in a magnetic force driving core 37 and ram 34 downwards. The downward force applied to the ram 34 within the solenoid 39 decreases as core 37 nears the bottom of solenoid 39 and there may be insufficient power to drive ram 34 onto the material and push the staple puller upwards to remove the staple. This drawback may be overcome by increasing the power of the solenoid, but this may cause too great an initial downwards force applied to the ram, potentially causing damage to the surface of the material or causing the horn to shear the crown off the staple. A pneumatically powered staple puller will allow for a more constant force. As well, a pneumatically powered staple puller lends itself well to the upholstery industry as many upholstery tools such as staple guns are pneumatically powered.

An optional feature for adjusting the height of the horn is shown in FIGS. 1–5. Tool extension 28 is provided with a circular adjustment member 90 adjacent to plunge rod 42 and affixed to horn pin 62. Horn pin 62 is an eccentric pin. When adjustment member 90 is rotated, the rotation of eccentric horn pin 62 causes pillow bushing 38 to move up and down thus adjusting the height of horn wedge 58 relative to the base of guide rod 46. Therefore, if staple 52 is deeply embedded in material 72, adjustment member 90 can be rotated so that horn wedge 58 is lower than the base of guide rod 46. When ram 34 is driven down, horn wedge 58 will be driven slightly below surface 74 of material 72 so that it passes below crown 50 of staple 52.

A further alternative embodiment of a staple puller 100 is shown in FIGS. 8 to 11. Staple puller 100 comprises a plunge member 102 and a pull member 104. Plunge member 102 is capable of slidable vertical movement with respect to pull member 104.

Plunge member 102 is composed of handle 106, bushing 108 and ram 110. Handle 106 is provided with a central cavity 112 and a cylindrical cavity 114 passing downwards through the base of handle 106. Cylindrical cavity 114 is defined at its top by the cylindrical bushing 108 at its bottom by the cylindrical ram 110. The diameter of bushing 108 is less than the diameter of ram 110.

Pull member 104 is composed of a finger grip 116, a plunge rod 118, a horn 120 mounted on a horn pin 122, a return spring 124 and a leaf spring 126. Finger grip 116 is generally coplanar with handle 106 and is positioned within central cavity 112. Plunge rod 118 is generally cylindrical in shape with a slotted or grooved base designed to receive a horn wedge 128 and a crown 130 of a staple 132. Plunge rod 118 is affixed to the base of finger grip 116 and extends through cylindrical cavity 114 within cylindrical bushing 108 and ram 110. Horn pin 122 is mounted near the midpoint of the portion of the plunge rod 118 which extends below handle 106. Leaf spring 126 is mounted to plunge rod 118 and abuts horn 120 such that horn wedge 128 pivots away from the base of plunge rod 118.

The base of return spring 124 is affixed to the outer surface of plunge rod 118 above horn pin 122 such that a portion of plunge rod 118 passes through the centre of return spring 124. The top of return spring 124 abuts the base of cylindrical bushing 108. Optionally, return spring 124 is affixed to the base of cylindrical bushing 108. Return spring 124 is sized such that when it is in its resting position (i.e. not compressed or stretched), the base of finger grip 116 abuts the top of cylindrical bushing 108.

Figure 8:
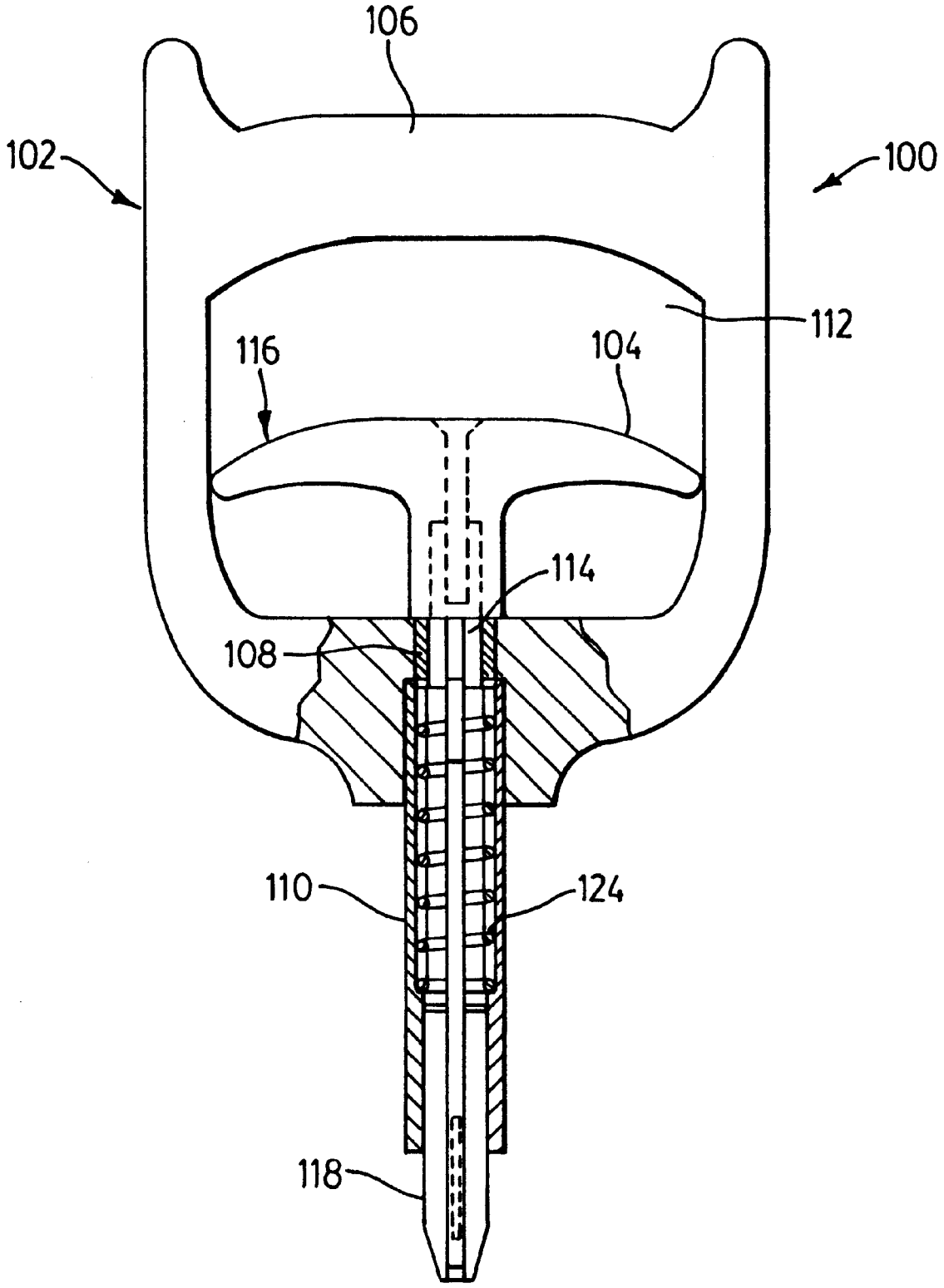
FIG. 8 is a partial sectional front view of a further alternative embodiment of the present invention.
Figure 9:
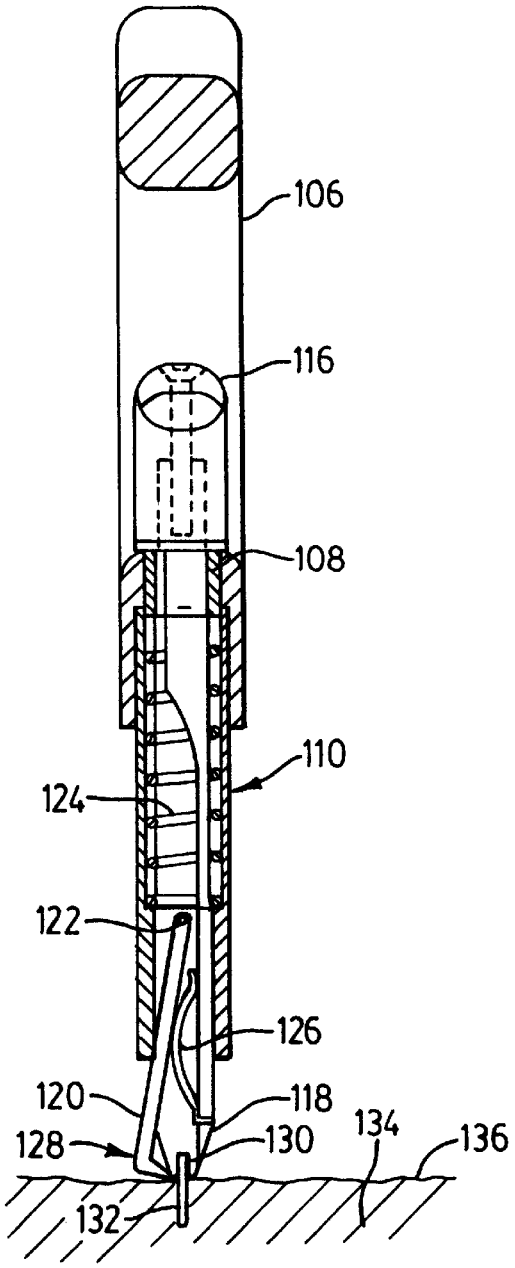
FIG. 9 is a partial sectional side view of the embodiment shown in FIG. 8 in the first position.

In use, the user grasps handle 106 and positions the staple puller 100 such that the base of plunge rod 118 is placed about the crown 130 of staple 132 which is embedded in material 134 as shown in FIG. 8. The user then pushes downwards firmly such that ram 110 slides over plunge rod 118 and forces horn 120 inwards until the base of ram 110 is flush with a top surface 134 of material 132 as shown in FIG. 9. Horn wedge 128 passes underneath the crown 130 of staple 132 pulling the staple slightly out from material 134. Because plunge member 102 is pushed downwards with respect to pull member 104, return spring 124 is compressed.

Figure 10:
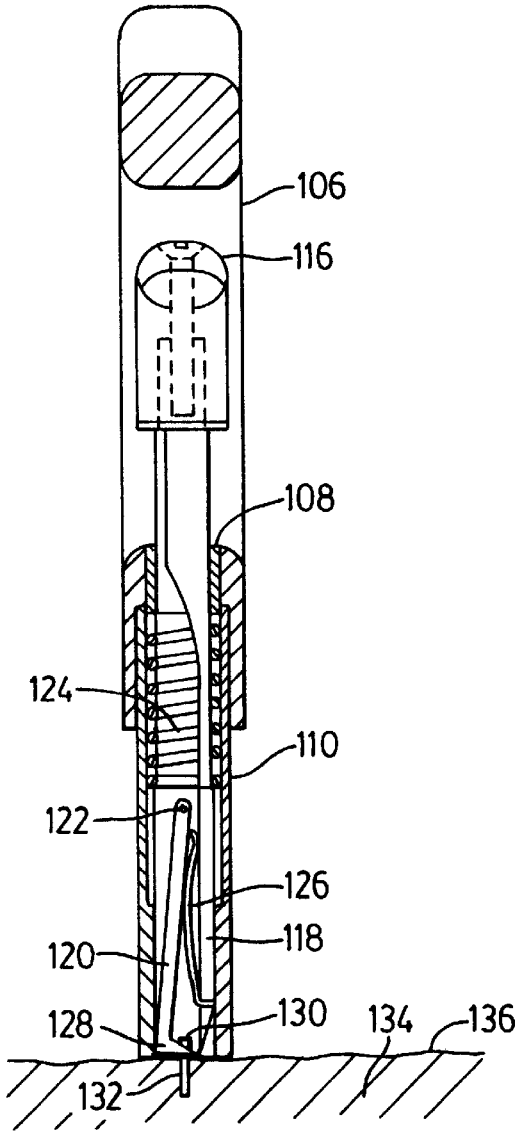
FIG. 10 is a partial sectional side view of the embodiment shown in FIG. 8 in the second position.
Figure 11:
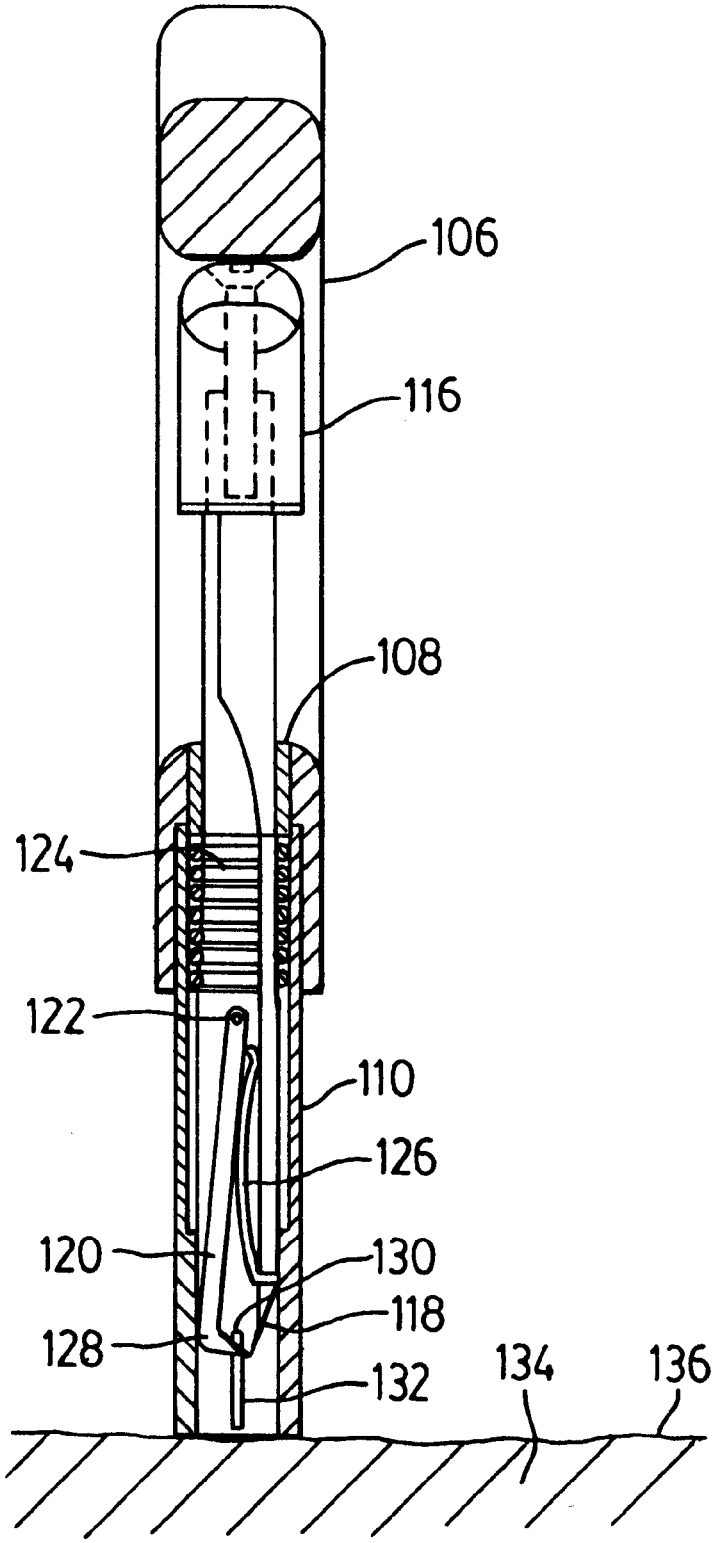
FIG. 11 is a partial sectional side view of the embodiment shown in FIG. 8 in the third position.

At this stage the user maintains a downwards force on handle 106 but releases some of their fingers to grasp finger grip 116. The user pulls finger grip 106 upwards as seen in FIG. 10. As a result, staple 132 which is grasped between horn wedge 128 and the base of plunge rod 118 is pulled out of material 134. The user may then release the downwards force on handle 106, allowing the force of return spring 124 to direct pull member 104 to its resting position.

Figure 12:
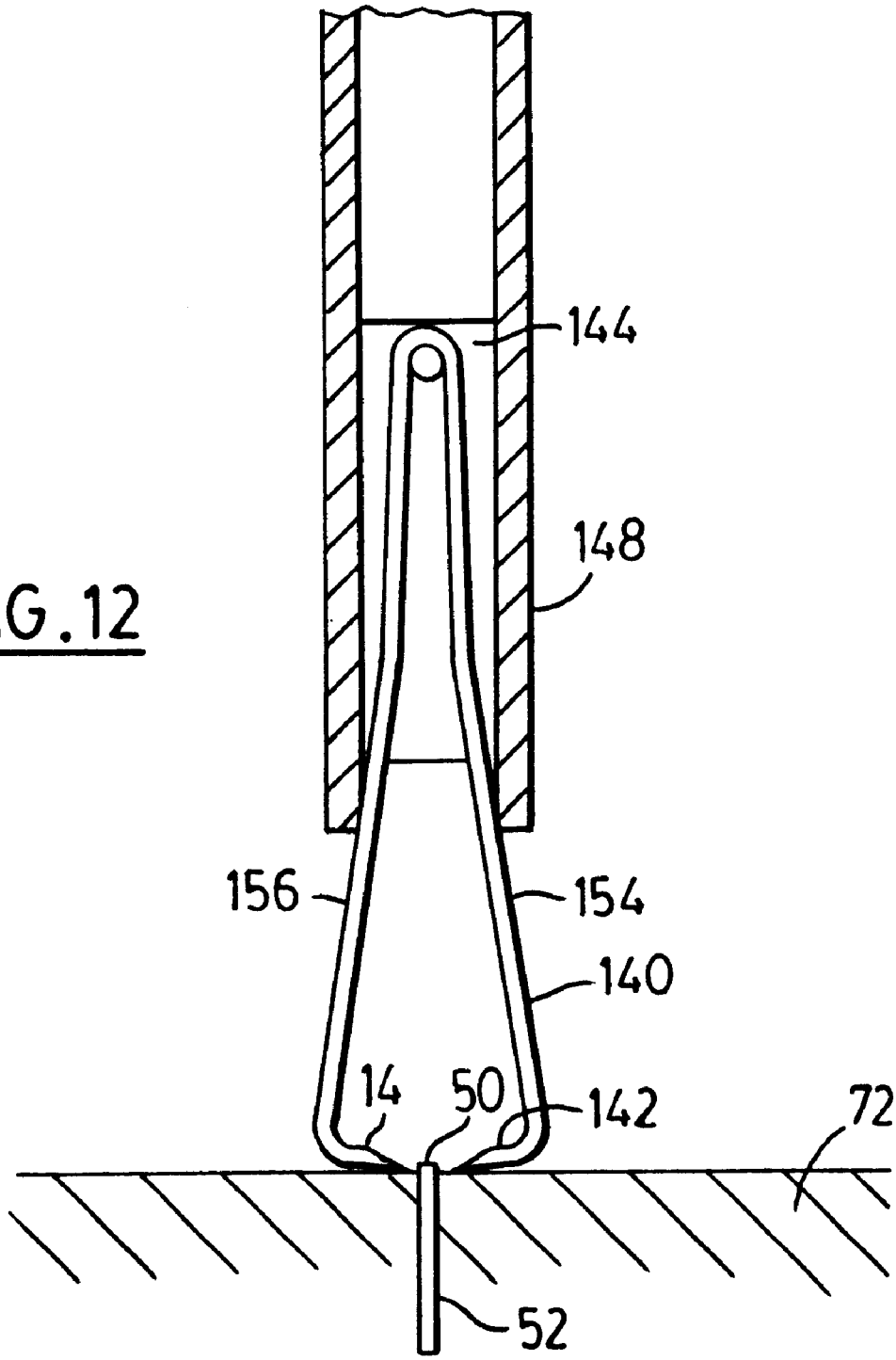
FIG. 12 is a side view of an alternative preferred embodiment of a tool extension in accordance with an aspect of the present invention.
Figure 13:
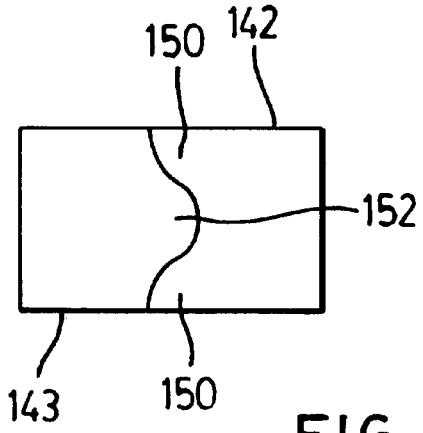
FIG. 13 is a bottom view of the horn of the embodiment shown in FIG. 12.

FIG. 12 shows a further alternative embodiment of the present invention. In this embodiment, a dual-wedge structure is used to remove the staple. Horn 140 is comprised of two stems 154,156 having inwardly facing horn wedges 142, 143 respectively. Horn 140 is bent at its midpoint and mounted to guide rod 144 by horn pin 146. Ram 148 is a rectangular body which completely surrounds guide rod 144 and horn 140 when lowered. When ram 148 is driven downwards, horn wedges are driven inwards towards staple 52 and are embedded under crown 50. Horn wedges 142, 143 are designed such that they pass by one another as they are driven beneath crown 50. An example configuration of horn wedges 142, 143 is shown in FIG. 13. In this configuration, horn wedge 142 is composed of two protruding wedge portions 150 along the sides of wedge 142 while horn wedge 143 has a protruding central wedge portion 152. Wedge portion 152 is shaped to fit between wedge portions 150 as shown in FIG. 13. Other configurations will be obvious to those skilled in the art. As with the other embodiments, as ram 148 continues its downwards motion, guide rod 144 moves upwards and pulls staple 52 out of material 72.

Figure 14:
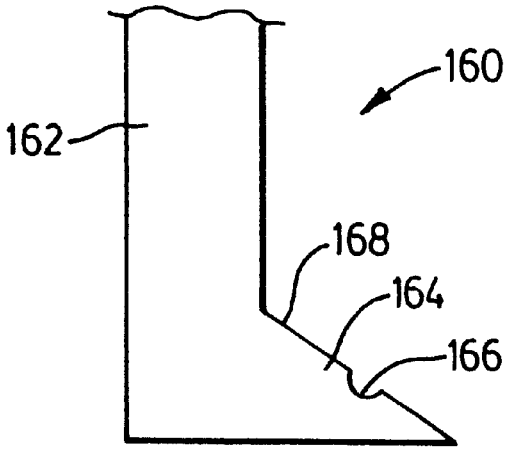
FIG. 14 is a side view of the lower portion of another embodiment of the horn.

FIG. 14 shows an alternative embodiment of the horn used in the various staple pullers described herein. Horn 160 has a stem 162 with a wedge 164 as previously described. Wedge 164 has a top surface 168. Top surface 168 is provided with an indentation or notch 166 extending across the width of the wedge for receiving the crown of the staple. As wedge 164 is driven underneath the crown of the staple, the crown slides upwards along top surface 168. When the crown of the staple passes over notch 166, the crown is caught and maintained in the notch. Any downward sliding of the crown is thus prevented. This version of the horn allows the staple to be stabilized in one position along wedge 164 when the staple is pulled out of the material. This is advantageous as the staple will tend to slide down top surface 68 of wedge 164 as the staple is pulled out if the material. Otherwise, the staple may press against the guide rod as it is removed, potentially causing the staple puller to jam. It is to be understood that various notch configurations can be used as is known to those skilled in the art.

Figure 15:
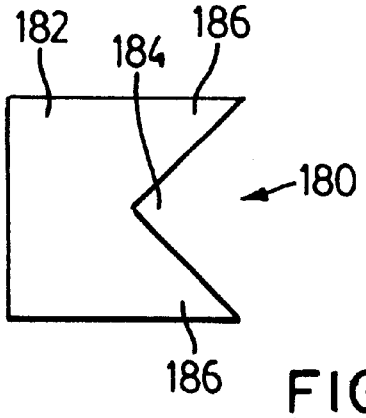
FIG. 15 is a bottom view of an alternative embodiment of the horn for use in a nail puller.

FIG. 15 shows a further alternative embodiment of the lower end of the horn for use in a powered nail puller. Wedge 182 of horn 180 is provided with a V-shaped notch 184 and wedge protrusions 186. As the ram forces the horn to a perpendicular position with respect to the surface, the wedge protrusions 186 pass underneath the head of the nail, lifting it out of the surface as the head slides up the wedge. The shank of the nail fits within notch 184 and horn 180 is positioned so that the movement of wedge 182 towards the nail does not shear off the head of the nail. As the ram abuts the surface, forcing the handle away from the surface, the nail will be pulled from the material. Depending on the length of the nail, the nail may be completely pulled from the material. If it is desired to pull longer nails from the material, a nail puller having a longer ram and a corresponding longer cylinder may be used. It will be obvious to those skilled in the art that other wedge configurations are possible for use in nail pullers.

It is to be understood that a wide variety of cross-sectional shapes of rams and guide rods are available to be used in any of the embodiments described.

It is to be understood that what has been described are preferred embodiments to the invention. The invention nonetheless is susceptible to certain changes and alternative embodiments fully comprehended by the spirit of the invention as described above, and the scope of the claims set out below.

I claim:

1. A fastener puller for removing a fastener embedded in a material having a surface, the fastener puller comprising:

a housing, said housing including a cylinder and a piston moveable within said cylinder, said cylinder fixedly mounted to said housing, a horn, said horn comprising an elongated stem, said stem having an end, a wedge at said end, said wedge adapted to fit underneath a head of the fastener, said horn being mounted for generally pivotable movement relative to said housing from a disengaged horn position to an engaged horn position;

a ram, said ram slidably mounted with respect to said housing for longitudinal slidable movement along a slide path from a first ram position through a second ram position to a third ram position relative to said housing, wherein said ram is mounted for said longitudinal movement with said piston relative to said cylinder and said horn is mounted for longitudinal movement with said cylinder relative to said piston, said horn positioned relative to said ram so that when said ram moves from said first ram position to said second ram position, said ram abuts said horn and causes said horn to move generally pivotally from said disengaged horn position to said engaged horn position;

said ram located to engage said surface when in said second ram position and when in said third ram position so that as said ram moves from said second ram position to said third ram position, said horn moves longitudinally with respect to said ram away from said surface.

2. A fastener puller as claimed in claim 1 further comprising pneumatic means for moving said ram along said slide path.

3. A fastener puller as claimed in claim 1 further comprising electrical means for moving said ram along said slide path.

4. A fastener puller as claimed in claim 1 further comprising a guide rod, said guide rod fixedly mounted with respect to said housing, said horn is mounted to said guide rod, said guide rod having an end remote from said housing, said guide rod comprising a slot at said end and said slot is adapted to receive said fastener as said fastener is removed from said material.

5. A fastener puller as claimed in claim 4 wherein the said horn is biased to said disengaged horn position.

6. A fastener puller as claimed in claim 5 wherein said stem of said horn is flexibly deformable, and said horn moves generally pivotably from said disengaged position to said engaged position by flexible deformation of said stem.

7. A fastener puller as claimed in claim 5 further comprising a biasing member for biasing said horn to said disengaged horn position.

8. A fastener puller as claimed in claim 4 further comprising an adjusting member for adjusting the longitudinal position of the horn relative to the guide rod.

9. A fastener puller as claimed in claim 1 further comprising a second horn said second horn having a second stem having an end, and a second wedge at said end, said second wedge adapted to fit underneath the head of the fastener, said second horn mounted for longitudinal movement with said cylinder relative to said piston, the second horn being moveable relative to said housing from a disengaged second horn position to an engaged second horn position, said second horn positioned relative to said ram so that when said ram moves from the first ram position to the second ram position, the ram abuts said second horn and causes said second horn to move from the disengaged second horn position to said engaged second horn position.

10. A fastener puller as claimed in claim 1 wherein the fastener is a staple having a crown, and the head of the fastener is the crown of the staple.

11. A fastener puller as claimed in claim 10 wherein the wedge comprises an indentation for receiving the crown of the staple when the horn is in the engaged position.

12. A fastener puller as claimed in claim 1 wherein the fastener is a nail having a head.

13. A staple puller for removing a staple embedded in a material having a surface, the staple puller comprising:

a plunge member composed of a ram handle and an elongated ram fixedly mounted with respect to the ram handle, the elongated ram having a lower end;

a pull member slidably mounted with respect to the plunge member and said pull member including a plunge rod and a horn, said horn pivotally mounted with respect to the plunge rod, the horn comprising an elongated stem, said stem having an end, and a horn wedge at said end, the wedge adapted to fit underneath a crown of the staple, said horn pivotable from a first horn position relative to the plunge rod to a second horn position, said horn positioned so that when the elongated ram is pushed towards and contacts the surface, aid elongated ram abuts the horn and causes said horn to move from said first horn position to said second horn position to engage said staple and said pull member located with respect to said plunge member so that said pull member may be moved away from the surface to remove the staple from the surface while the end of the plunge member remains in contact with the surface.

14. A staple puller as claimed in claim 13 wherein said plunge rod comprises a slot adapted to fit about a crown of a staple.

15. A staple puller as claimed in claim 13 wherein the horn is biased to said first horn position.

16. A staple puller as claimed in claim 14 further comprising a biasing member for biasing the horn to said first horn position.

17. A staple puller as claimed in claim 14 further comprising an adjusting member for adjusting the position of the horn relative to the guide rod.

* * * * *